US007648675B2

(12) United States Patent
Zhang et al.

(10) Patent No.: US 7,648,675 B2
(45) Date of Patent: Jan. 19, 2010

(54) REACTION SINTERED ZIRCONIUM CARBIDE/TUNGSTEN COMPOSITE BODIES AND A METHOD FOR PRODUCING THE SAME

(76) Inventors: Shi C. Zhang, 1115 Sycamore Dr., Rolla, MO (US) 65401; Gregory E. Hilmas, 494 Countryside Dr., Rolla, MO (US) 65401; William G. Fahrenholtz, 1014 Iron Horse Rd., Rolla, MO (US) 65401

( * ) Notice: Subject to any disclaimer, the term of this patent is extended or adjusted under 35 U.S.C. 154(b) by 329 days.

(21) Appl. No.: 11/539,384

(22) Filed: Oct. 6, 2006

(65) Prior Publication Data

US 2009/0291011 A1 Nov. 26, 2009

(51) Int. Cl.
*C22C 1/05* (2006.01)

(52) U.S. Cl. ..... 419/17

(58) Field of Classification Search ..... None
See application file for complete search history.

(56) References Cited

U.S. PATENT DOCUMENTS

| | | | | |
|---|---|---|---|---|
| 4,689,077 | A | 8/1987 | Chevigne et al. | |
| 4,828,584 | A * | 5/1989 | Cutler | 51/307 |
| 5,567,662 | A * | 10/1996 | Dunmead et al. | 501/87 |
| 5,720,910 | A * | 2/1998 | Vlajic et al. | 264/29.1 |
| 6,271,162 | B1 * | 8/2001 | Haug et al. | 501/87 |
| 6,407,022 | B1 | 6/2002 | Sandhage et al. | |

(Continued)

OTHER PUBLICATIONS

Dickerson et al., Near net-shape, ultra-high melting, recession-resistant ZrC/W-based rocket nozzle liners via the displacive compensation of porosity (DCP) method, Journal of Materials Science 39 (2004) 6005-6105.

(Continued)

*Primary Examiner*—Melvin C Mayes
*Assistant Examiner*—Stefanie Cohen
(74) *Attorney, Agent, or Firm*—C. John Brannon; Brannon & Associates PC

(57) ABSTRACT

A method of sintering a composite body characterized by a transition metal carbide phase (such as a ZrC phase) substantially evenly distributed in a second, typically refractory, transition metal (such as W) matrix at ambient pressures, including blending a first predetermined amount of first transition metal oxide powder (such as $ZrO_2$) with a second predetermined amount of second transition metal carbide powder (such as WC powder). Next the blended powders are mixed to yield a substantially homogeneous powder mixture and a portion of the substantially homogeneous powder mixture is formed into a green body. The body is fired to a first temperature, wherein the first transition metal oxide is substantially reduced and the simultaneously generated CO and gas are evolved from the body to substantially eliminate oxides from the green body, and the body is heated to a second temperature and sintered to yield a composite body of about 99 percent theoretical density and characterized by a first transition metal carbide phase distributed substantially evenly in a second transition metal matrix.

22 Claims, 4 Drawing Sheets

U.S. PATENT DOCUMENTS

| | | | |
|---|---|---|---|
| 6,598,656 | B1 | 7/2003 | Sandhage et al. |
| 6,878,427 | B2 | 4/2005 | Schmidt et al. |
| 6,893,711 | B2 | 5/2005 | Williamson et al. |
| 2003/0006269 | A1 | 1/2003 | Horner et al. |
| 2003/0013794 | A1 | 1/2003 | Matsumoto et al. |
| 2006/0154800 | A1 | 7/2006 | Chen |

OTHER PUBLICATIONS

Hyuga et al., Mechanical and wear properties of Si3N4-W composites using tungsten boride powder, J. Mater. Res., vol. 18, No. 9, Sep. 2003.

Song et al, The Microstructure and elevated temperature strength of tungsten-titanium carbide composite, Journal of Materials Science 37 (2002) 3541-3548.

Sandhage, The displacive compensation of porosity (DCP) method for fabricating dense, shaped, high-ceramic-bearing bodies at modest temperatures, Journal of Materials Science 34 (1999) 5757-5769.

Song et al., The mechanical and thermophysical properties of ZrC/W composites at elevated temperature, Materials Science and Engineering A334 (2002) 223-232.

Song et al., Effect of carbide particles on the ablation properties of tungsten composites, Materials Characterization 50 (2003) 293-303.

* cited by examiner

REACTION SINTERED ZIRCONIUM CARBIDE/TUNGSTEN COMPOSITE BODIES AND A METHOD FOR PRODUCING THE SAME

ACKNOWLEDGEMENT

Research leading to this invention was federally supported by grant nos. FA8650-04-C5704 from the U.S. Department of the Air Force. The government has certain rights in this invention.

TECHNICAL FIELD

The novel technology relates generally to the field of ceramic composites, and, more particularly, to a reaction sintered body including a metal (such as zirconium) carbide phase substantially evenly disbursed in a transition metal (such as tungsten) matrix and a method for making the same.

BACKGROUND

Traditionally, metal carbide/transition metal composites, such as, for example, zirconium carbide (ZrC) disbursed in a tungsten (W) matrix, have been fabricated by a hot pressing process. Mixtures of metal carbide phase and transition metal matrix phase powders are placed in a pressure vessel and are subjected to elevated pressures while heated to high temperatures, typically in an inert atmosphere or under vacuum. Typically, substantially dense composite bodies are formed by first measuring, mixing and blending the raw materials as powders. The blended powders are then loaded into a simple geometrical model, such as a graphite die, where the blended raw materials undergo heating and pressing simultaneously. The simultaneous application of heat and pressure provides sufficient urging forces to cause the powders to sinter and substantially completely densify. Although hot pressing is not required per se for the sintering of such composites, sintering without the application of elevated pressures results in weak bodies characterized by densities only about 90 percent of theoretical and having poor thermal and mechanical properties. Therefore, the densified bodies so produced are limited by the constraints of the hot pressing die to simple shapes and moderate sizes. Further, hot pressing techniques require expensive hot pressing facilities and provide a slow rate of production. Moreover, the bodies produced by hot pressing techniques are simple and unfinished, thus typically requiring further diamond machining in order to produce a finished end product. Such machining adds considerable time and financial cost.

In the hot pressing processes, the attendant high pressures are necessary to provide sufficient driving force for substantial densification to occur, since the mixed carbide and transition metal powders alone typically lack sufficient self-diffusion characteristics when heated to sintering temperatures. The use of high sintering pressures addresses this problem by providing an externally generated driving force to the system, but also adds complexity and cost to the fabrication of the composite bodies, since hot pressing requires expensive facilities and provide a slow rate of component production. Further, the application of high pressure adds inherent geometrical constraints that limit the bodies so formed to simple geometric shapes. The hot pressing technique is therefore limited to the fabrication of simple shapes of moderately sized parts. Due to the very high melting temperature of many desirable matrix transition metals, such as metallic tungsten, and their low self-diffusion coefficient, the highest density obtained by hot pressing is typically less than 90% of theoretical density.

Recently, an alternate fabrication technique using displacive compensation of porosity (DCP) has been used to fabricate ZrC/W composites, in which a low melting point metal alloy (herein, $Zr_2Cu$) is infiltrated into, and reacted with, a porous tungsten carbide (WC) preform at elevated temperatures, such as the range 1200-1300° C. for an extended soak period, such as 8 hours.

Although the DCP method lends itself to lower pressure processing and thus may be used to produce relatively large, complex shaped parts, it still suffers from several drawbacks. For example, the DCP method remains a two step process, with the first step being formation of a WC preform and the second step requiring the need for liquid metal infiltration followed by a reaction. Further, the pores produced in the WC preform, as required by the DCP method, cannot be completely eliminated after the infiltration and reaction step. Typically, 5% porosity remains in the final products of ZrC/W composites produced by the DCP method. In addition, metallic copper-rich phases, typically undesirable impurities having a relatively low melting point (≦1083° C.), cannot be completely eliminated during the DCP process, and thus remain as impurities. Moreover, the porosity and pore size distribution of the WC preforms cannot be precisely controlled. Therefore, the composition and microstructure of the final products are not reproducible or reliable, as W, ZrC, residual WC, $Zr_2Cu$ and porosity vary from part to part.

Thus, there remains a need for a simple, quick and low-cost means of fabricating and sintering metal carbide/transition metal matrix composite bodies, such as ZrC/W, having complex shapes at ambient pressures. The present novel technology addresses this need.

SUMMARY

The present novel technology relates to a method of sintering metal carbide/transition metal matrix composite bodies having substantially uniform microstructures without the need of elevated pressures and/or excessive finishing.

One object of the present novel technology is to provide an improved method for producing metal carbide/transition metal matrix composite bodies, such as ZrC/W bodies. Related objects and advantages of the present novel technology will be apparent from the following description.

DESCRIPTION OF THE PREFERRED EMBODIMENTS

Figure 1:
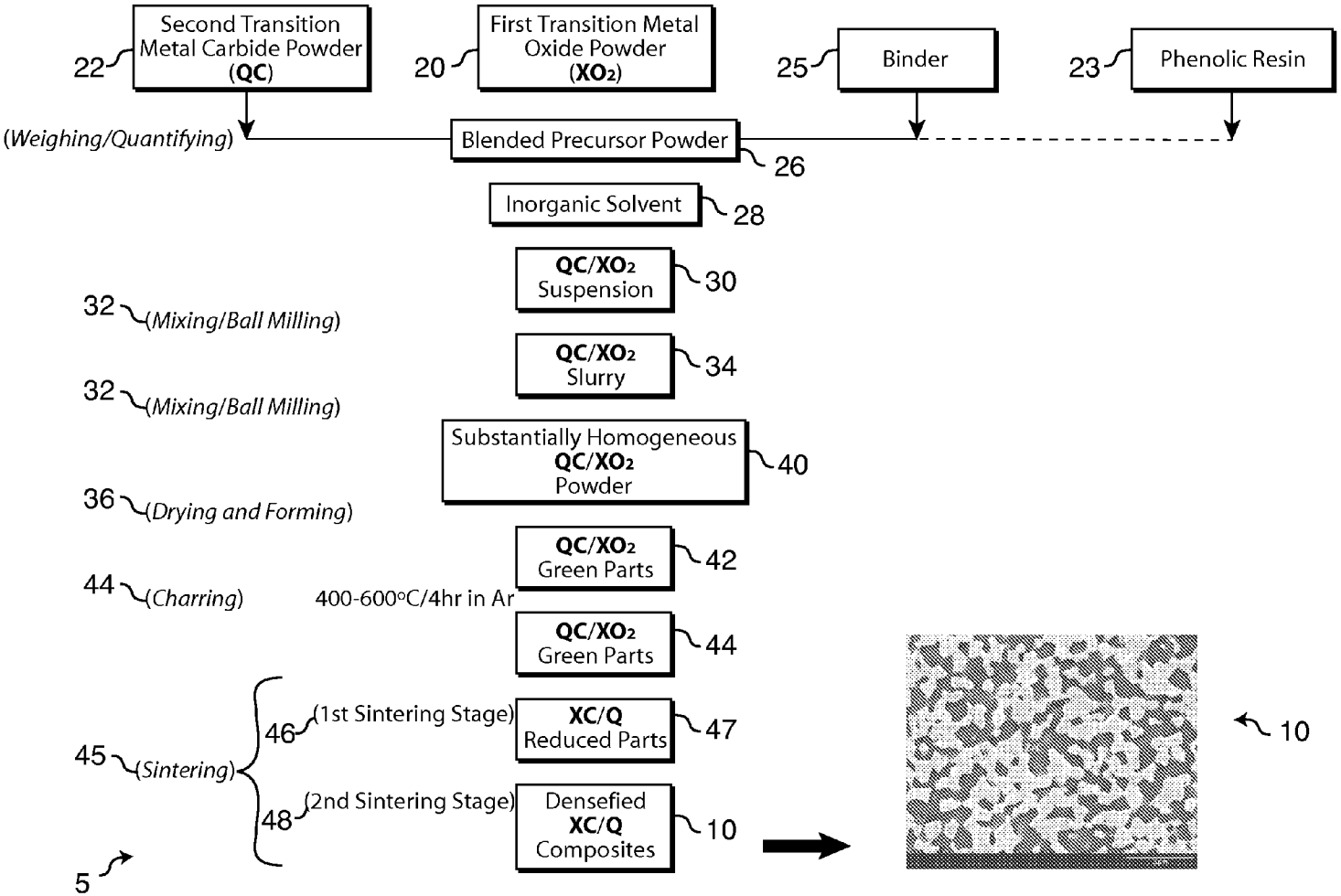
FIG. 1 is a schematic diagram illustrating a method for manufacturing a first transition metal carbide/second transition metal matrix composite body to substantially full density without the application of high pressures according to a first embodiment of the novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

Densified transition metal carbide/transition metal composites, such as zirconium carbide (ZrC)— tungsten (W) composites or tantalum carbide (TaC)—W composites are attractive as ultra-high melting point materials that are also characterized as having high strength and hardness, as well as being chemically stable and having attractive thermal and electrical properties. Materials having this combination of properties are rare, and thus transition metal carbide/refractory transition metal composites are desired for applications in the aerospace field, as well as in electrode, cutting tool, machining tool, and molten metal containing crucible applications and the like.

For example, the dispersed phase may be a carbide of such transition metals as Ta, Th, La, Zr, Hf, Ti, V, Nb or the like. Likewise, the refractory metal matrix phase is usually taken to be W, but may also be Cr, Mo, or the like. One transition metal carbide/refractory transition metal system of interest is the ZrC/W system. The ZrC/W system is discussed in detail hereinbelow as illustrative of the novel reaction sintering techniques for producing a densified transition metal carbide/transition metal composite. It should be appreciated that the transition metal carbide (WC), the transition metal oxide ($ZrO_2$), and the resulting transition metal carbide/transition metal (ZrC/W) composite used to demonstrate the novel technology do not limit the process and/or compositional ranges taught by the present novel technology.

Figure 2:
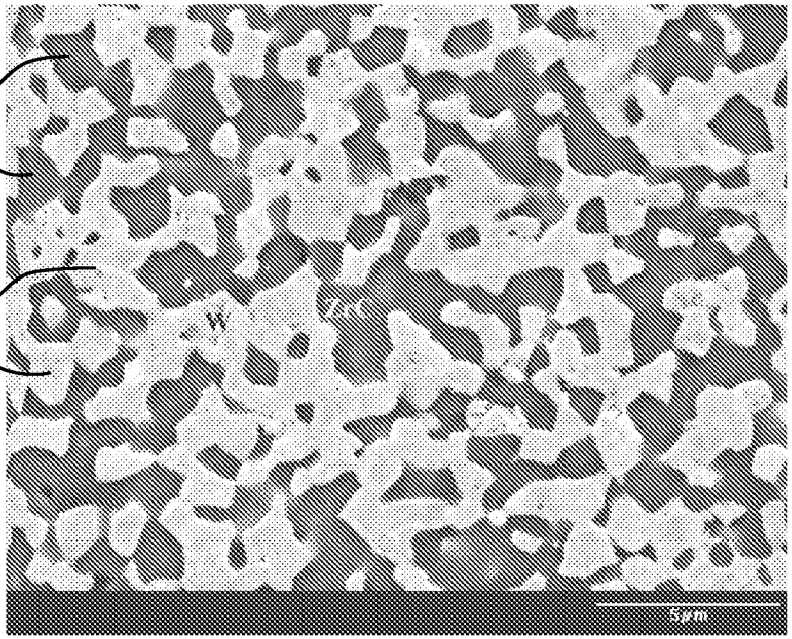
FIG. 2 is a photomicrograph of one embodiment of the novel technology, a first transition metal carbide/second transition metal matrix composite body characterized by first transition metal carbide inclusions substantially evenly distributed in a second transition metal matrix.

FIG. 1 illustrates in detail the process 5 for manufacturing substantially densified first transition metal carbide/second transition metal matrix composite bodies 10 at low or ambient pressures. In operation, a pressurelessly sintered first transition metal carbide/second transition metal matrix composite body 10, as shown in detail in FIG. 2, is typically formed substantially free of oxide impurities and, more typically, with a composition of between about 25 volume percent to about 60 volume percent first transition metal carbide phase 12 distributed in a second transition metal matrix phase 14, which substantially accounts for the rest of the composite composition.

The composite body 10 may be produced as follows. First, a measured amount of a first transition metal oxide powder 20 (such as $ZrO_2$, $Ta_2O_5$, $TiO_2$, or the like) is combined with a measured amount of a second transition metal carbide powder 22 (such as WC, MoC, or the like), along with smaller amounts of organic binders 24, and then mixed. Typically, the first and second precursors 20, 22 are mixed in a molar ratio of about 1:3 first transition metal to second transition metal, although the ratio may vary from between about 2:3 and about 1:5. In some instances, an additional organic binder 24 is selected that will further contribute free carbon to the system to participate in the reduction of the first transition metal oxide 20 to form the first transition metal carbide phase 12. Typically, an organic solvent 28 is added to the mixed powders 26 to form a suspension 30, which may then be further mixed 32, such as by ball milling, to form a substantially homogeneous slurry 34. The slurry 34 may then be dried 36 (such as by pan drying, spray drying or the like) and a substantially homogenous mixed powder precursor 40 may be recovered.

A portion of the substantially homogeneously blended powder mixture 40 is typically then separated and formed into a green body 42. If binders and/or resins are present in the green body 42, the green body 42 is first heated to a temperature sufficient for the binder to decompose and volatilize 44, such as to between about 400 and about 600 degrees Celsius. Binder burnout and/or resin carbonization 44 are typically accomplished in an inert atmosphere to prevent excessive gas evolution that might damage the green body 42.

Next, the temperature is elevated and the green body 42 is then typically "soaked" or allowed to remain at one or more elevated temperatures 46 (such as about 1850 degrees Celsius) for sufficient time for the first transition metal oxide 20 to react with the second transition metal carbide 22 to form a first transition metal carbide phase 12, a second transition metal metallic phase 14, and carbon monoxide and/or carbon dioxide gas. This soak is typically done in a very low oxygen partial pressure atmosphere, such as a flowing, non-oxide gas (such as helium, argon, or similar gas mixtures), or, more typically, in a vacuum or partial vacuum (to encourage evolution and removal of carbon monoxide/dioxide gas) to produce an oxide-reduced or partially-sintered body 47. The temperature of the so-formed reacted and partially-sintered body 47 is then raised to a temperature sufficient for substantially complete densification to occur in a matter of hours (such as to about 2100 degrees Celsius) 48. The body 47 is then soaked at the elevated temperature 48 for a time sufficient for substantially full densification to occur (such as a temperature of about 2100 degrees Celsius for 4 to 6 hours) to yield a substantially theoretically dense sintered body 10. This final sintering and densification soak 48 is usually done in an inert gas atmosphere.

Figure 3:
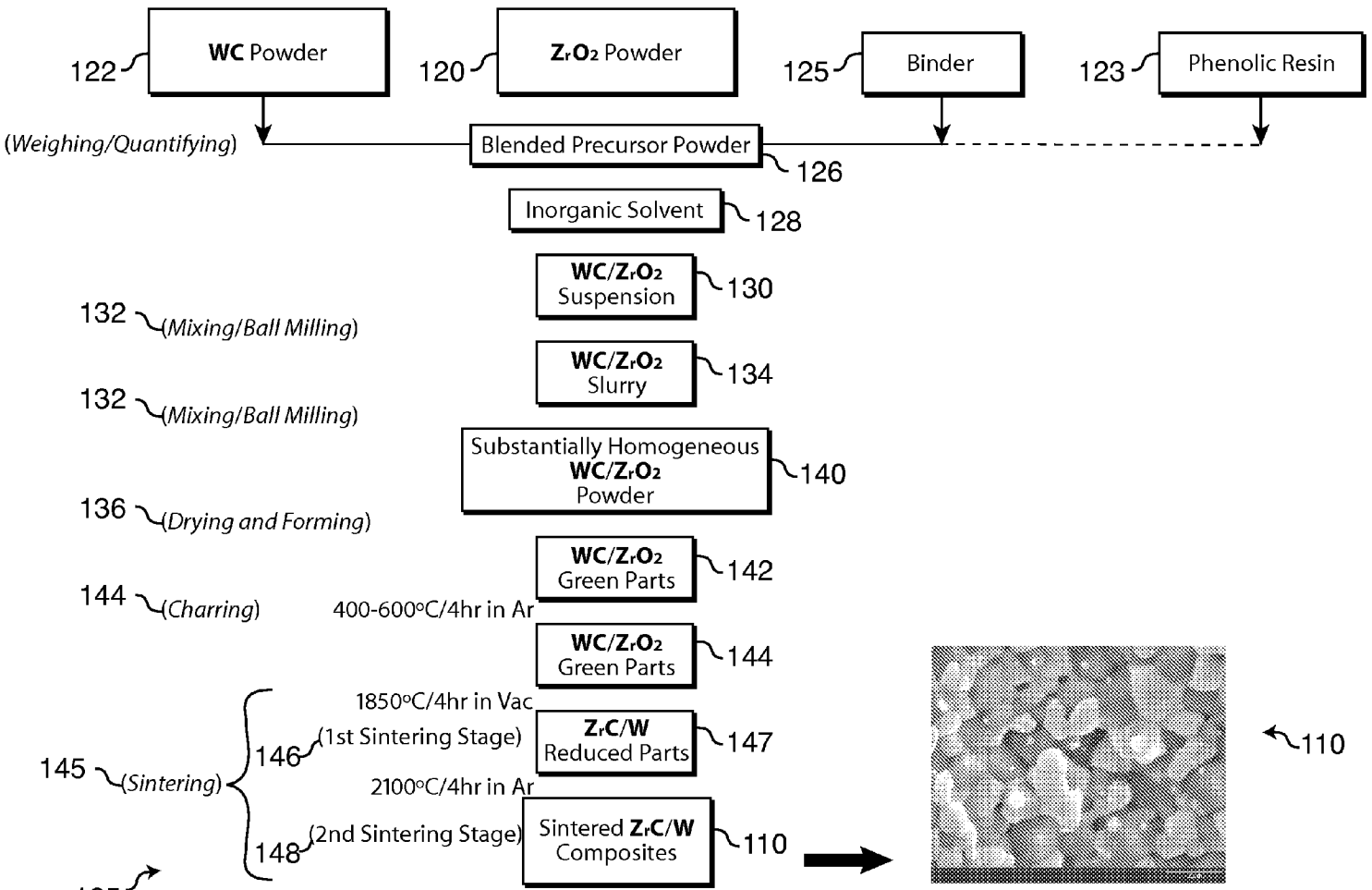
FIG. 3 is a schematic diagram illustrating a method for manufacturing a ZrC/W metal matrix composite body to substantially full density without the application of high pressures according to a second embodiment of the novel technology.
Figure 4:
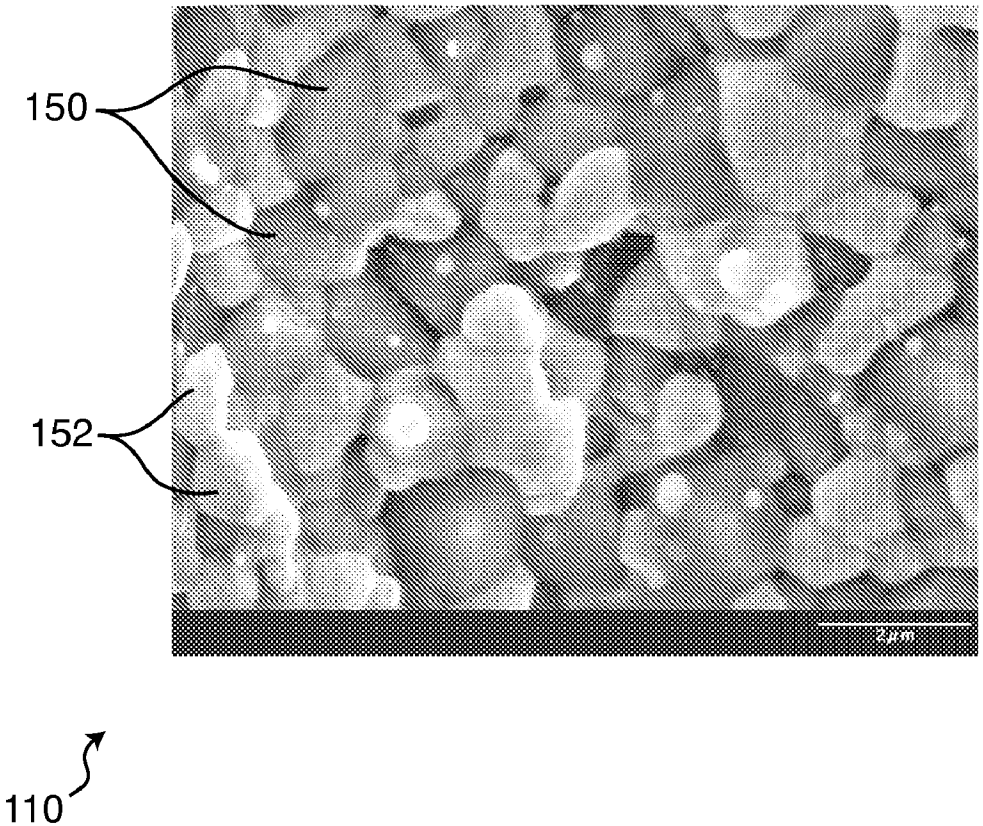
FIG. 4 is a photomicrograph of one embodiment of the novel technology, a ZrC—W composite body characterized by ZrC inclusions substantially evenly distributed in a W matrix.

FIG. 3 illustrates in detail a process 105 for making a ZrC/W 150, 152 composite material 110 (illustrated in detail in FIG. 4) formed by admixing WC and $ZrO_2$ powders 122, 120 with a binder material 125 in designed fractions to form a precursor mixture 140. The precursor mixture 140 may then be shaped into green bodies 142 using conventional ceramic forming techniques. The green bodies 142, consisting of a substantially homogeneous mixture of WC and $ZrO_2$ 122, 120, undergo binder burnout 144, followed by pressureless sintering to produce a ZrC/W composite 110, near its theoretical density, microstructurally consisting of particles of a ZrC phase 150 uniformly dispersed in a W matrix 152.

The novel technology presently discussed utilizes a solid phase reaction between tungsten carbide (WC) 122 and zirconium oxide ($ZrO_2$) 120 at elevated temperature to produce an ultrahigh temperature zirconium carbide/tungsten composite 110 that is sintered substantially to its theoretical density. WC and $ZrO_2$ powders 122, 120, are typically blended to form a mixture 126 having a stoichiometric molar ratio of 3:1, although the ratios may vary depending upon the desired ZrC:W ratio in the composite body 110. The mixture 126 may be dispersed in a non-aqueous solvent 128, such as methyl ethyl ketone (MEK) or the like, to form a suspension 130 and then mixed 132, such as by ball milling or the like. After mixing 132, such as by ball milling for 24 hours using WC media, the resulting substantially homogeneous slurry 134 is then typically dried 136, such as by spray or pan drying or the like, and then the resulting agglomerated material 140 is sized, such as by grinding and/or sieving, to obtain "agglomerated" grains of the admixed composition 140. These grains, containing admixed WC an $ZrO_2$ with substantially a 3:1 molar ratio, may then be formed as green bodies 142 with designed geometry and dimension by any convenient powder processing technique, such as via uniaxial and/or cold isostatic pressing (CIP), injection molding, extrusion or the like.

The green bodies 142 undergo binder burnout 144 at relatively low temperatures (such as at 400° C. for 2-6 hours under a flowing argon (Ar) atmosphere), followed by "pressureless" sintering 145 (i.e., sintering at room pressure conditions with no externally applied pressure) in a graphite furnace. Typically, the pressureless sintering process 145 can be divided into two stages: 1) a reaction period 146 from room temperature to a first elevated temperature (such as about 1850° C. for the ZrC/W system), typically under vacuum conditions, to yield a reacted and partially densified composite body 147 characterized by the presence of ZrC and W phases 150, 152; and 2) a sintering period 148 involving a relatively fast ramp to a second, greater elevated temperature (such as about 2100° C. for the ZrC/W system), followed by a thermal soak at the second elevated temperature for a sufficient time for sintering to occur in an inert atmosphere (such as for about 4 hours in a flowing Ar atmosphere for the ZrC/W system).

The final sintered product 110, of the 3:1 stoichiometric molar ratio of $WC/ZrO_2$, contains a substantially fixed 65 vol % metallic tungsten (W) 152 and 35 vol % zirconium carbide (ZrC) 150. In order to modify the compositions of the final ZrC/W composite body 110 for different applications, an additional amount of ZrC powder 150 or corresponding amount of $ZrO_2$ 120 and free carbon 125, may be added to the stoichiometric $WC/ZrO_2$ raw powder admixtures 126 or an additional amount of W and/or WC powder 152, 122, may be added, depending upon the desired composition of the final composite material. For example, a final sintered product 110 containing 50 vol % ZrC/50 vol % W, and also near its theoretical density, has been obtained from an admixture containing $WC/ZrO_2/C$ powders 122, 120, 123 in a 3:1.08:0.24 molar ratio using the process of the present novel technology. A microstructural investigation of the latter ultrahigh temperature carbide/metal composites 110 indicates that a dense particulate ZrC phase 150 is uniformly distributed in a dense W matrix 152.

In one embodiment, a powder mixture 126 is defined as having a compositional range of between about 1 and about 3 moles of WC 122 for each mole of $ZrO_2$ 120. Free carbon 123 (typically up to about 4 weight percent) may be added to the system, typically via dissolved phenolic resin as a carbon precursor, to effectively remove provide sufficient carbon for substantially complete reduction of $ZrO_2$ 120 and/or other oxide impurities that may be present. More typically, a small amount (typically between about 0 and about 4 wt. percent) of binder 124 (such as polypropylene carbonate) is likewise added to enhance the pressability of the material.

Typically, fine WC and $ZrO_2$ powders 122, 120 in designed volume or mass fraction are dispersed in a non-aqueous solvent 128, such as Methyl Ethyl Ketone (MEK). The suspension 130 is typically mixed 132, such as by ball milling, planetary mixing, or attrition milling for a predetermined amount of time (typically about 24 hours for ball milling with WC milling media). A free carbon source 123, such as 3 wt. percent phenolic resin, based on the total weight of $ZrO_2$ and WC, may be added to the mixture followed by further mixing 132 (such as ball milling for an additional 24 hours). If mixing was done in slurry form, the slurry 134 is then dried 136 to yield a powder mixture 140. The powder mixture 140 is typically ground and sieved to yield agglomerates of the powder mixture 140. This could also be accomplished by a spray drying technique or the like. The agglomerates are then formed into green bodies 142, such as by uni-axial pressing and/or cold isostatic pressing (CIP) in molds of a desired shape. Pressing 138 is typically done at 40-50 Kpsi. The green bodies 142 may alternately be formed through other known techniques, such as via injection molding, extrusion, slip casting or the like to produce more complex shapes by those skilled in the art.

The green bodies 142 typically undergo binder burnout/resin carbonization 144 through exposure to sufficiently elevated temperatures in a low oxygen or inert gas atmosphere for sufficient time to substantially completely volatilize the present binder material 124 (such as in flowing Ar at 400 degrees Celsius to about 600 degrees Celsius for 2-4 hours). Binder burnout/resin carbonization 144 is typically followed by sintering under ambient pressure conditions (or "pressureless" sintering) 145 (more typically in a graphite or tungsten furnace) at a sufficiently elevated temperature (typically at least about 2050 degrees Celsius) for a time sufficient to achieve theoretical or near-theoretical density (such as about 6 hours at 2050 degrees Celsius).

The sintering process 145 is more typically divided into two stages 146, 148. The first stage 146 is a reaction period that may be defined as the temperature range from room temperature to at least about 1650 degrees Celsius to about 1900 degrees Celsius under vacuum. In this stage 146, the first transition metal oxide $ZrO_2$ phase 120 is reduced and converted to a first transition metal carbide ZrC phase 150, while any present oxide impurities are removed from the system. Once the first transition metal oxide phase $ZrO_2$ 120 is substantially reduced to first transition metal carbide phase ZrC 150 and the second transition metal carbide phase WC 122 is converted to a metallic W phase 152 to define a reacted and partially densified body 147, the second stage 148 may be initiated. The second stage 148 is a sintering period that may be typically defined by the temperature range from about 1900 degrees Celsius to the final sintering temperature (typically about 2150° C. or higher). The second stage 148 typically occurs in the presence of an inert gas atmosphere at ambient pressures, such as one provided by flowing Ar. After the second stage 148 is complete, the sintered bodies 110 have substantially achieved near theoretical density. The microstructure of the sintered bodies 110 typically is characterized by the morphology of the ZrC phase 150 being present as more or less spherical or equiaxial inclusions 150 that are uniformly distributed in a W matrix 152. FIG. 2 shows a W matrix 152 having substantially uniformly dispersed ZrC inclusions 150 therein. In this example, the ZrC inclusions 150 are typically about 2 microns in diameter, but may be made larger or smaller by variation of processing times and temperatures.

According to one aspect of the present novel technology, a method 105 of producing substantially dense ZrC—W composite materials 110 without the use of applied pressures during sintering, or otherwise hot pressing, generally includes the steps of:

(a) mixing between about 40 mole percent and about 75 mole percent QC powder, between about 0 and about 4 weight percent reducing agent, and about 1 volume percent to about 5 volume percent organic binder material with X-oxide powder to produce a substantially homogeneously blended powder mixture;

(b) forming a portion of the substantially homogeneously blended powder mixture into a green body;

(c) heating the green body to at least about 400 degrees Celsius in an inert atmosphere;

(d) substantially reducing oxides present in the green body and reacting X with C to form a partially densified reacted body;

(e) placing the partially densified reacted body in an inert gas atmosphere and elevating the temperature of the partially densified reacted body to a temperature sufficient for sintering to progress; and (f) soaking the partially densified reacted body in an inert gas atmosphere at a temperature sufficient for sintering to progress for sufficient time to yield a substantially theoretically dense sintered body (i.e., a body having very low porosity, typically less than 2 percent, more typically less than 1 percent, and still more typically less than 0.5 percent).

As detailed above, the free carbon source/reducing agent 123 is typically a free carbon additive, such as carbon black or phenolic resin, added during the powder precursor blending/mixing step 132. WC 122 is typically present in an amount from about 25 volume percent to about 60 volume percent, and is more typically present in an amount from about 30 volume percent to about 40 volume percent.

Further, while step (f) above could be performed under elevated pressures, such as in a hot isostatic press, such pressures are unnecessary.

It should be appreciated that the transition metal carbide (WC), the transition metal oxide ($ZrO_2$), and the resulting transition metal carbide/transition metal (ZrC/W) composite used to demonstrate the novel technology do not limit the process taught by the present novel technology.

The novel technology presently discussed utilizes a solid phase reaction between tungsten carbide (WC) and zirconium oxide ($ZrO_2$) at elevated temperature to produce an ultrahigh temperature zirconium carbide (ZrC)/tungsten (W) composite that is sintered to near its theoretical density as part of the process. WC and $ZrO_2$ powders, having a stoichiometric molar ratio of 3:1, were dispersed in a non-aqueous solvent, such as methyl ethyl ketone (MEK). After ball milling for 24 hours using WC media, the slurry was spray dried or pan dried, ground and sieved to obtain "agglomerated" grains of the admixed composition. These grains, containing admixed WC an $ZrO_2$ with a 3:1 molar ratio, are then formed as green bodies with designed geometry and dimension using uniaxial and/or cold isostatic pressing (CIP). Those skilled in the art of ceramic processing will appreciate that similar green bodies of the admixed WC and $ZrO_2$ powders can also be formed by injection molding, extrusion or other forming techniques. The green bodies undergo binder burnout at 400° C. for 2-6 hours under a flowing argon (Ar) atmosphere, followed by pressureless sintering in a graphite furnace. The pressureless sintering process can be divided into two stages: 1) a reaction period from room temperature to 1850° C. under vacuum conditions; and 2) a sintering period involving a fast ramp to 2100° C., followed by a thermal soak at 2100° C. for 4 hours in a flowing Ar atmosphere.

The final sintered product, of the 3:1 stoichiometric molar ratio of $WC/ZrO_2$, contains a fixed 65 vol % metallic tungsten (W) and 35 vol % zirconium carbide (ZrC). In order to modify the compositions of the final ZrC/W composites for different applications, the ZrC:W ratio may be modified. The ZrC:W ratio can be increased through two methods: one is through the addition of fine ZrC into the starting powder mixture, and a second method would be through the addition of ZrO2 and carbon which would react to form stoichiometric ZrC. The two methods can presented as:

$$3WC+ZrO_2+xZrC=3W+(1+x)ZrC+2CO(g) \quad 1)$$

$$3WC+(1+x)ZrO_2+3xC=3W+(1+x)ZrC+2(1+x)CO(g) \quad 2)$$

Likewise, the ZrC:W ratio of the product may be decreased through the addition of W metal powder or oxide to the starting batch.

As an example, a final sintered product containing 50 vol % ZrC/50 vol % W, and also near its theoretical density, has been obtained from an admixture containing $WC/ZrO_2/C$ in a 3:1.08:0.24 molar ratio using the process of the present novel technology. A microstructural investigation of the latter ultrahigh temperature carbide/metal composites indicates that dense ZrC is uniformly distributed in a dense W matrix.

Example 1

A ZrC/W composite material was formed by admixing WC and $ZrO_2$ powders with a binder material in designed fractions to form a precursor mixture. The precursor mixture was shaped into green bodies using normal ceramic forming techniques. The green bodies, consisting of a substantially homogeneous mixture of WC and $ZrO_2$, underwent binder burnout at 400 degrees Celsius, followed by pressureless sintering to produce a ZrC/W composite, near its theoretical density, microstructurally consisting of ZrC uniformly dispersed in a W matrix.

Example 2

A ZrC/W composite precursor composition may be formed by admixing WC and $ZrO_2$ powders together in a 3:1 molar ratio with an additional 1 weight percent organic binder added to increase pressability. The starting composition may be dispersed in a MEK liquid medium and ball milled for 24 hours with WC media so as to be thoroughly mixed. The slurry of the mixed powders may be dried to yield a mixed powder with binder, and the recovered powder may be ground and sieved to a predetermined desired granule size distribution. A portion of the sieved granules may then be formed into a green body via cold isostatic pressing. The green body may then be heated to about 400 degrees Celsius in flowing argon and held at that temperature for 4 hours to decompose and volatilize the binder. The green body may then be heated to 1850 degrees Celsius in a partial vacuum and held there for 4 hours to react the zirconium oxide with the tungsten carbide to form zirconium carbide and tungsten metal and (evolved) gases, such as CO gas. The green body (now the reduced body or partially sintered body) is then heated to 2050 degrees Celsius in flowing Argon and held there for 6 hours to yield a sintered ZrC—W composite body having a porosity of less than 0.5 percent containing substantially evenly dispersed ZrC particles in a W matrix.

3WC+1.0 ZrO2 was processed at 2100° C. for 4 hours in an Ar atmosphere. The final product consists of 65 vol % of W and 35 vol % ZrC. This indicates that the ZrC fraction may be changed in the final products.

Example 3

A ZrC—W composite characterized by equal volume percents of ZrC particles and W matrix material may be formed by admixing WC, ZrO2, and C starting materials according to the following stoichiometry: 3WC+1.8 ZrO2+2.4C. The initial composition may be dispersed in a MEK liquid medium and ball milled for 24 hours with WC media so as to be thoroughly mixed. The slurry of the mixed powders may be dried to yield a mixed powder with binder, and the recovered powder may be ground and sieved to a predetermined desired granule size distribution. A portion of the sieved granules may then be formed into a green body via cold isostatic pressing.

The green body may then be heated to about 450 degrees Celsius in flowing argon and held at that temperature for 4 hours to decompose and volatilize the binder. The green body may then be heated to 1900 degrees Celsius in a partial vacuum and held there for 2 to 4 hours to react the $ZrO_2$ with the WC and C reducing agent additive to form ZrC and gaseous $CO_2$ and CO. The green body (now the reduced body or partially sintered body) is then heated to 2100 degrees Celsius in flowing Argon and held there for 4 hours to yield a sintered ZrC—W composite body with a porosity of less than about 1 percent.

Example 4

A TaC—W composite composition may be formed from the mixture of $Ta_2O_5$ and WC powders according to the relationship $7WC+5Ta_2O_5=7W+2TaC+5CO(g)$. In addition to the above starting powders, 1 to 2 weight percent organic binder may be added to enhance pressability. The composition may be dispersed in an MEK or hexane liquid medium and ball milled for 24 hours with WC media so as to be thoroughly mixed. The slurry of the mixed powders may be dried to yield a mixed powder with organic binders, and the recovered powder may be ground and sieved to a predetermined desired granule size distribution. A portion of the sieved granules may then be formed into a green body via uniaxial pressing followed by cold isostatic pressing. The green body may then be heated to about 450 degrees Celsius in flowing argon and held at that temperature for 4 hours to decompose and volatilize the binder. The green body may then be heated to at least about 1450 degrees Celsius in a partial vacuum and held there for 6 hours to react the $Ta_2O_5$ and WC to yield TaC, metallic W and gaseous CO. The green body (now the reduced body or partially sintered body) is then heated to 2100 degrees Celsius in flowing Argon and held there for 4 hours to yield a substantially theoretically dense sintered TaC—W composite body.

Example 5

A HfC—W composite composition may be formed from the mixture of $HfO_2$ and WC powders according to the relationship $3WC+HfO_2=3W+HfC+2CO(g)$. In addition to the above starting powders, 1 to 2 weight percent organic binder may be added to enhance pressability. The composition may be dispersed in an MEK or hexane liquid medium and ball milled for 24 hours with WC media so as to be thoroughly mixed. The slurry of the mixed powders may be dried to yield a mixed powder with organic binders, and the recovered powder may be ground and sieved to a predetermined desired granule size distribution. A portion of the sieved granules may then be formed into a green body via uniaxial pressing followed by cold isostatic pressing. The green body may then be heated to about 450 degrees Celsius in flowing argon and held at that temperature for 4 hours to decompose and volatilize the binder. The green body may then be heated to at least about 2000 degrees Celsius in a partial vacuum and held there for 6 hours to react the $HfO_2$ and WC to yield HfC, metallic W and gaseous CO. The green body (now the reduced body or partially sintered body) is then heated to 2200 degrees Celsius in flowing Argon and held there for 5 hours to yield a substantially theoretically dense sintered HfC—W composite body.

Example 6

A TiC—W composite composition may be formed from the mixture of $TiO_2$ and WC powders according to the relationship $3WC+TiO_2=3W+TiC+2CO(g)$. In addition to the above starting powders, 1 to 2 weight percent organic binder may be added to enhance pressability. The composition may be dispersed in an MEK or hexane liquid medium and ball milled for 24 hours with WC media so as to be thoroughly mixed. The slurry of the mixed powders may be dried to yield a mixed powder with organic binders, and the recovered powder may be ground and sieved to a predetermined desired granule size distribution. A portion of the sieved granules may then be formed into a green body via uniaxial pressing followed by cold isostatic pressing. The green body may then be heated to about 400 degrees Celsius in flowing argon and held at that temperature for 4 hours to decompose and volatilize the binder. The green body may then be heated to at least about 1600 degrees Celsius in a partial vacuum and held there for 6 hours to react the $TiO_2$ and WC to yield TiC, metallic W and gaseous $CO_2$ and CO. The green body (now the reduced body or partially sintered body) is then heated to 2000 degrees Celsius in flowing Argon and held there for 5 hours to yield a substantially theoretically dense sintered TiC—W composite body.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

What is claimed is:

1. A method of sintering a first transition metal carbide/second transition metal matrix composite body at ambient pressures, comprising in combination:

a) blending a first predetermined amount of X oxide powder with a second predetermined amount of QC powder;

b) mixing the blended powders to yield a substantially homogeneous powder mixture;

c) forming a portion of the substantially homogeneous powder mixture into a green body;

d) heating the green body to a first elevated temperature to form a partially sintered body which has reacted to form at least some XC and Q phases; and e) heating the partially sintered body to a second elevated temperature in an inert atmosphere to yield a substantially dense sintered body;

wherein the substantially dense sintered body is substantially XC dispersed in a substantially Q matrix;

wherein X is a first transition metal; and wherein Q is a second transition metal different from X.

2. The method of claim 1 wherein d) is performed in a substantially reduced oxygen partial pressure environment.

3. The method of claim 1 further wherein e) is performed in a noble gas environment.

4. The method of claim 3 wherein the noble gas environment is flowing Argon.

5. The method of claim 3 wherein during (d), oxygen is removed from the green body as a gaseous oxide.

6. The method of claim 1 wherein X is selected from the group including Ta, Th, La, Zr, Hf, Ti, V, Nb; and wherein Q is selected from the group including W, Cr and Mo.

7. The method of claim 1 wherein X is Zr, Q is W, the first elevated temperature is at least about 1850 degrees Celsius and the second elevated temperature is about 2100 degrees Celsius.

8. The method of claim 1 wherein X is Hf, Q is W, the first elevated temperature is at least about 2000 degrees Celsius and the second elevated temperature is about 2200 degrees Celsius.

9. The method of claim 1 wherein X is Ta, Q is W, the first elevated temperature is at least about 1450 degrees Celsius and the second elevated temperature is about 2100 degrees Celsius.

10. The method of claim 1 wherein X is Ti, Q is W, the first elevated temperature is at least about 1600 degrees Celsius and the second elevated temperature is about 2080 degrees Celsius.

11. The method of claim 1 wherein during d), the green body is under a partial vacuum.

12. The method of claim 1 wherein d) occurs in a partial vacuum and e) occurs in an inert gas atmosphere.

13. A method of preparing a composite material having a ZrC phase dispersed in a W matrix, comprising:

(a) blending between about 25 mole percent and about 45 mole percent $ZrO_2$, between about 0 and about 4 weight percent binder with WC to produce a substantially homogeneously blended powder mixture;

(b) forming a portion of the substantially homogeneously blended powder mixture into a green body;

(c) soaking the green body at a temperature of from about 400 to about 600 degrees Celsius in an inert atmosphere to substantially eliminate any present organic and resin materials;

(d) heating the green body in a substantially oxygen-free environment to a first temperature sufficient to cause the WC to react with any $ZrO_2$ present to form a metallic W phase, a solid ZrC phase and CO gas and to produce a partially-sintered body; and (e) heating the partially-sintered body in an inert gas atmosphere to a temperature sufficient to sinter the partially-sintered body to produce a substantially theoretically dense sintered body.

14. The method of claim 13 wherein the substantially theoretically dense sintered body is characterized by substantially evenly distributed ZrC particulate phase substantially uniformly dispersed in a W matrix.

15. The method of claim 13 wherein d) occurs in a partial vacuum.

16. The method of claim 15 wherein the ZrC particles are generally spherical and are about 1 to 3 μm in diameter.

17. The method of claim 13 wherein the substantially theoretically dense sintered body has a porosity of about 1 percent.

18. A method of producing a pressurelessly sintered XC—Q composite body substantially free of oxide impurities with a composition of about 25 mole percent to about 60 mole XC present as a substantially uniform distribution of XC particles, with the rest being a substantially Q metallic matrix, comprising the steps of:

(a) mixing between about 45 mole percent and about 75 mole percent QC powder, between about 0 and about 4 weight percent reducing agent, and about 1 weight percent to about 2 weight percent organic binder material with X-oxide powder to produce a substantially homogeneously blended powder mixture;

(b) forming a portion of the substantially homogeneously blended powder mixture into a green body;

(c) heating the green body to at least about 400 degrees Celsius in an inert atmosphere;

(d) substantially reducing oxides present in the green body and reacting X with C to form a partially densified reacted body;

(e) placing the partially densified reacted body in an inert gas atmosphere and elevating the temperature of the partially densified reacted body to a temperature sufficient for sintering to progress; and (f) soaking the partially densified reacted body in an inert gas atmosphere at a temperature sufficient for sintering to progress for sufficient time to yield a substantially theoretically dense sintered body;

wherein X is selected from the group consisting of Ta, Th, La, Zr, Hf, Ti, V, Nb; and wherein Q is selected from the group consisting of W, Mo and Cr.

19. The method of claim 18 wherein during f) the temperature sufficient for sintering to progress is at least about 2000 degrees Celsius and sufficient time to yield a substantially theoretically dense sintered body is about 4 hours.

20. The method of claim 18 wherein the substantially theoretically dense sintered body is characterized by XC particles substantially evenly dispersed in a metallic W matrix.

21. The method of claim 18 wherein the reducing agent is carbon.

22. The method of claim 18 wherein the reducing agent is selected from the group carbon black, graphite, boron carbide, WC, ZrC, HfC, $Mo_2C$, and NbC or combinations thereof.

* * * * *